United States Patent [19]

Okuno et al.

[11] Patent Number: 4,836,183

[45] Date of Patent: Jun. 6, 1989

[54] ROTARY BODY ROOM AIR HEATER

[75] Inventors: Masaharu Okuno, Osaka; Toshihiro Ishibashi, Kosai; Satoshi Naitou, Kosai; Tatsuyoshi Sasaki, Hamamatsu, all of Japan

[73] Assignees: Osaka Gas Company, Ltd., Osaka; Kabushiki Kaisha Hamatech, Shizuoka, both of Japan

[21] Appl. No.: 171,344

[22] Filed: Mar. 21, 1988

[51] Int. Cl.[4] ..... F24H 3/06

[52] U.S. Cl. ..... 126/110 R; 165/7; 126/110 AA; 126/110 B

[58] Field of Search ..... 165/7, 10; 126/110 R, 126/110 AA, 110 B

[56] References Cited

U.S. PATENT DOCUMENTS 3,695,250 10/1972 Rohrs et al. ..... 165/7
4,497,361 2/1985 Hajieck ..... 165/7

FOREIGN PATENT DOCUMENTS 127445 10/1975 Japan .
168052 12/1981 Japan .

*Primary Examiner*—Albert W. Davis, Jr.
*Attorney, Agent, or Firm*—Armstrong, Nikaido, Marmelstein, Kubovcik & Murray

[57] ABSTRACT

A heater is adapted to provide heat for heating a room by effecting heat exchange in a heat section which is between combustion and ventilation sections. The heat exchange section comprises a rotary body positioned across the combustion and ventilation sections so as to rotate at that position. The rotary body has air flow passages extending in the same direction as the axis of rotation of the rotary body. The heater can effect heat exchange with an increased efficiency and also can prevent the interior of the room from being abnormally dried.

2 Claims, 7 Drawing Sheets

ROTARY BODY ROOM AIR HEATER

BACKGROUND OF THE INVENTION

1. Field of the Invention

The present invention relates to a heater, more specifically, to a heater which is capable of exchanging heat between air sucked from the interior of a room and combustion heat generated during the combustion of a fuel such as gas or kerosene, with a very high level of efficiency.

2. Description of the Prior Art

An FF type warm air heater is conventionally known.

A known warm air heater of this type has a construction which can be outlined as follows: the heater is adapted to burn a fuel with air sucked from the exterior of the room and discharge air to the exterior of the room after the air has been used in the combustion; the heater is also adapted to perform heat exchange between air at a high temperature resulting from the combustion and air sucked from the interior of the room until the air at the high temperature is discharged to the exterior of the room, and forcibly supply the interior of the room with the air which has been subjected to heat exchange and thus had its temperature raised.

Such a conventional heater mainly comprises a combustion section, a ventilation section, a heat exchange section between the combustion and ventilation sections, and a frame body which accommodates these members.

The combustion section has a combustion chamber, a suction port for supplying fresh air from the exterior of the room to the inside of the combustion chamber by a suction fan, and an exhaust port communicating with the exterior of the room for discharging the air which has been used in the combustion to the exterior of the room. The heat exchange section is positioned between the combustion chamber and the exhaust port.

The ventilation section has a suction port disposed on one side of the frame body for sucking air from the interior of the room, a discharge port disposed on the other side of the frame body for discharging air to the interior of the room, and a ventilation fan disposed between the suction and discharge ports, so that the sucked air is forcibly subjected to heat exchange.

The heat exchange section is disposed between the combustion chamber and the exhaust port for providing heat exchange with air sucked from the interior of the room by the ventilation section. Air at high temperature resulting from the combustion passes through the heat exchange section, and, during the passage of the air, its temperature is reduced by a level corresponding to the energy used to raise the temperature of the air sucked from the interior of the room. Thereafter, the air which has had its temperature reduced is discharged to the exterior of the room.

The conventionally known heater has the advantage that it enables the room to be heated without causing any reduction in the freshness of the air within the room. The conventional heater, however, has the following disadvantages:

(1) Low Heat Exchange Efficiency

In the above-described conventional heater, air sucked from the interior of the room is subjected to heat exchange by the heat exchange section with heat generated by the combustion gases. If, however, it is attempted to increase the heat exchange efficiency by increasing the heat transfer area of the heat exchanger, there is a risk of moisture condensing in the heat exchanger. Such moisture condensation may result in corrosion of the heat exchanger. Accordingly, it has been necessary to set the heat exchange efficiency of a conventional heater to within a range which is low enough to prevent moisture condensation, and it has been impossible to increase the heat exchange efficiency beyond this range.

(2) Large Heat Exchanger Volume

The efficiency of the heat exchange in the heat exchange section between air at high a temperature provided by the combustion gases and air at a low temperature sucked from the interior of the room can be increased by increasing the heat transfer area of the heat exchanger. This increase in the transfer area, however, causes an increase in the resistance to the flow of air in the flow passages caused by the ventilation fan. In order to cope with this problem, it is common practice to enlarge the cross-section of the flow passages. Since the heat exchanger per se must have an increased volume to provide an increased heat exchange efficiency, these arrangements made the overall structure of the heater large.

(3) Drying of Air within the Room

Since the conventional heater is adapted to discharge all the air which has been used in the combustion, the moisture in that air is also discharged after it has been vaporized during the combustion. This arrangement, therefore, abnormally dries the interior of the room as it is heated by the heater.

SUMMARY OF THE INVENTION

The present invention has been accomplished to solve the above-stated problems. An object of the present invention is to provide a heater which is provided with a rotary body positioned across combustion and ventilation sections of the heater so as to rotate at that position, and with air passages formed in the rotary body for effecting heat exchange, and which is capable of performing heat exchange with an increased efficiency and is also capable of supplying vapor generated during combustion to the interior of the room to thereby prevent the interior of the room from being abnormally dried.

According to the present invention, there is provided a heater adapted to provide heat for heating a room by effecting heat exchange in a heat exchange section which is between a combustion section and a ventilation section. The heat exchange section comprises a rotary body positioned across the combustion section and the ventilation section so as to rotate at that position, the rotary body having air flow passages extending in the same direction as the axis of rotation of the rotary body.

With the heater in accordance with the present invention, the rotary body having air flow passages is positioned across the combustion and ventilation sections so as to rotate at that position.

During the rotation of the rotary body, the part of the rotary body that is positioned on the side of the heater where the combustion section is located has its temperature raised by heat generated by combustion while the heat is passing through the flow passage.

When the part of the rotary body whose temperature has been raised in this way is moved to and positioned on the side of the heater where the ventilation section is located, air flowing in the ventilation section passes through the flow passages of the rotary body. During this passage of the air, the heat of the heated part of the rotary body is transferred to the air sucked from the interior of the room into the ventilation section.

Accordingly, if the combustion section and ventilation section are each operated continuously and simultaneously as the rotary body is continuously rotated, the heat exchange section is able to effect continuous heat exchange, thereby enabling a highly efficient heat exchange.

In addition, since the internal pressure on the ventilation section side of the rotary member is higher than that on the combustion section side thereof, it is possible to prevent air from flowing from the combustion section side to the ventilation section side, thereby preventing the air used in combustion from flowing through the ventilation section. This effect is provided even if the heater is adapted to discharge air used in combustion to the outside in order to prevent any reduction in freshness of air within the room.

DESCRIPTION OF THE PREFERRED EMBODIMENTS

Certain embodiments of the present invention will be described hereunder with references to the drawings.

Figure 1:
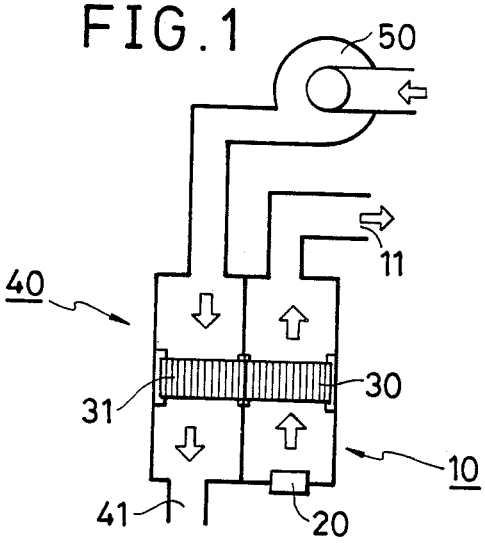
FIG. 1 is a view schematically illustrating the basic construction of a heater in accordance with the present invention.

FIG. 1 schematically illustrate the basic construction of a heater of the present invention.

As schematically shown in FIG. 1, the heater is provided with air flow routes which are: a combustion route extending from a gas burner unit 20 disposed in a combustion section 10 of the heater to an exhaust port 11 through a rotary body 30; and a heating route extending from a heat exchange fan 50 serving as a ventilation section 40 of the heater to a discharge port 41 through the rotary body 30.

The rotary body 30 is positioned across these combustion and ventilation sections 10 and 40 so as to rotate at that position. The rotary body 30 has air flow passages 31 which extends in the same direction as the axis of rotation thereof.

The rotary body 30 provided with the flow passages 31 is used as a heat exchange section. Therefore, air at a high temperature resulting from combustion by the gas burner unit 20 is allowed to pass through the flow passages 31 before the air arrives at the exhaust port 11. When the high-temperature air is passing through the flow passages 31, the air heats the rotary body 30.

On the other hand, air sucked from the interior of the room by the heat exchange fan 50, which acts as the ventilation section 40, passes through the flow passages 31 of the rotary body 30 before the air arrives at the discharge port 41. Therefore, if the flow passages 31 are at a high temperature, heat is exchanged between the passages 31 and the air while the air is passing therethrough.

The rotary body 30 is adapted to rotate continuously. Therefore, while the body 30 rotates, part of the body 30 which has been heated in the combustion section 10 is moved to the other side of the heater where the ventilation section 40 is located.

The part of the rotary body 30 which has thus been heated and moved to the ventilation section 40 side then exchanges heat with air which is being forced to circulate through the interior of the room and the heater by the ventilation section 40, whereby the air is heated while that part of the rotary body 30 is cooled.

In this way, by virtue of the combustion in the combustion section 10, the ventilation provided by the ventilation section 40, and the rotation of the rotary body 30, heat exchange in which the rotary body 30 acts as a heat exchange section is continuously effected.

Moisture is generated by the combustion in the combustion section 10. Part of the moisture is discharged to the discharge port 11 through the flow passages 31 of the rotary body 30, while the remaining moisture attaches to the passages 31 of the rotary body 30. The part of the moisture generated by the combustion in the combustion section 10 that has attached to the flow passages 31 of the rotary body 30 is allowed to join an air flow from the heat exchange fan 50 when the part of the rotary body 30 that carries the moisture has been moved to the ventilation section 40 side by the rotation of the rotary body 30, and the moisture is then discharged from the discharge port 41.

Therefore, the heater of the present invention is capable of moistening air to be supplied to the room, using moisture generated by the combustion, while the heater heats the air.

An experiment has proved that, with the heater of the present invention, heat exchange was such that, even if the temperature of the combustion section 10 was 1000° C. while the gas burner unit 20 was in use, the temperature of the air discharged from the exhaust port 11 was about 50° C.

One embodiment of the present invention will now be described with reference to FIG. 2.

Figure 2:
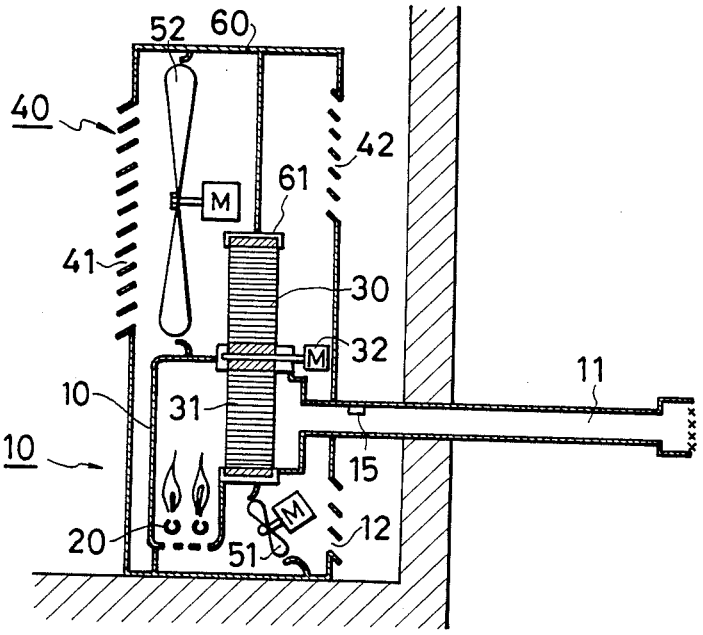
FIGS. 2 to 6 are views illustrating heaters in accordance with specific embodiments of the present invention.

As shown in FIG. 2, a heater in accordance with this embodiment comprises: a combustion section 10; a ventilation section 40; a rotary body 30 which is positioned across the combustion and ventilation sections 10 and 40 so as to rotate at that position and has air flow passages 31, the rotary body 30 serving as a heat exchange section; and a frame body 60 accommodating these members.

The combustion section 10 has a suction fan 51 and a gas burner unit 20, and the section 10 acts to cause air within the room to be forcibly sucked through a suction port 12, and cause combustion of gas being discharged from the gas burner unit 20 with the air sucked into the combustion section, so as to provide combustion heat. The air used in the combustion is discharged to the exterior of the room through the exhaust port 11 which is connected to the combustion section 10 through the rotary body 30.

The ventilation section 40 has a ventilation fan 52 which also serves as a heat exchange fan, and the section 40 acts to cause air within the room to be sucked through a suction port 42 by the fan 52 and be discharged through the discharge port 41 after the air has passed through the rotary body 30. With this arrangement, therefore, air sucked through the suction port 42 into the ventilation section 40 always passes through the flow passages 31 of the rotary body 30 before the air is forcibly discharged from the discharge port 41.

The heat exchange section is positioned across the combustion and ventilation sections 10 and 40 and comprises the rotary body 30 which is rotatable.

The rotary body 30 has an overall configuration formed by a cylinder made of a thin material. The body 30 is supported by a guide 61 provided within the frame body 60 and is adapted to be driven by a rotary motor 32.

The actual use and operation of the heater in accordance with this embodiment, which has the above-described construction will be described.

First, the suction fan 51 of the combustion section 10, the ventilation fan 52 of the ventilation section 40, and the rotary motor 32 for the rotary body 30 are each started, and, simultaneously, the gas burner unit 20 of the combustion section 10 is ignited.

By this actuation, the combustion section 10 performs combustion of gas from the gas burner 20 with air sucked from the interior of the room by the suction fan 51, and the heat of high-temperature combustion gases, which are generated by the combustion, are introduced through the flow passages 31 of the rotary body 30. When the gases are passing through the flow passages 31, they heat the part of the rotary body 30 that is positioned within the combustion section 10. The temperature of the gases is reduced by a level corresponding to the energy used in the heating, and the gases are then discharged from the exhaust port 11.

Part of the vapor contained in the combustion gases becomes attached to the flow passages 31 of the rotary body 30 as the temperature of the gases drops during the heating of the rotary body 30. If a moisture-absorbing material is provided in the flow passages 31, the vapor can be efficiently absorbed and retained thereby.

The part of the rotary body 30 that is on the combustion section 10 side and that has had its temperature raised in this way is then rotated by the rotary motor 32 to the ventilation section 40 side so as to be positioned on this side while its temperature is still high.

Air is forcibly supplied by the ventilation fan 52 from the interior of the room to this part of the rotary body 30, which is now on the ventilation section 40 side, so that heat is exchanged between the air and that part of the rotary body 30 while the air is passing through the flow passages 31 of the body 30. By this action, the temperature of the air rises, while that of that part of the rotary body 30 drops.

In addition, the vapor attached to the flow passages 31 of the rotary body 30, or absorbed and retained by the moisture-absorbing material if this is provided, is allowed to evaporate during the heat exchange and is mixed with the air. Therefore, the air is discharged to the interior of the room as highly-moist, warm air.

While heat exchange proceeds in this way between the air sucked from the interior of the room and the heat exchange section of the heater, since the rotary body 30 continues to rotate, part of the body 30 positioned in the ventilation section 40 is then moved into the combustion section 10 in which it is heated, and it is again moved into the ventilation section 40 in which it exchanges heat with air sucked from the interior of the room.

Figure 3:
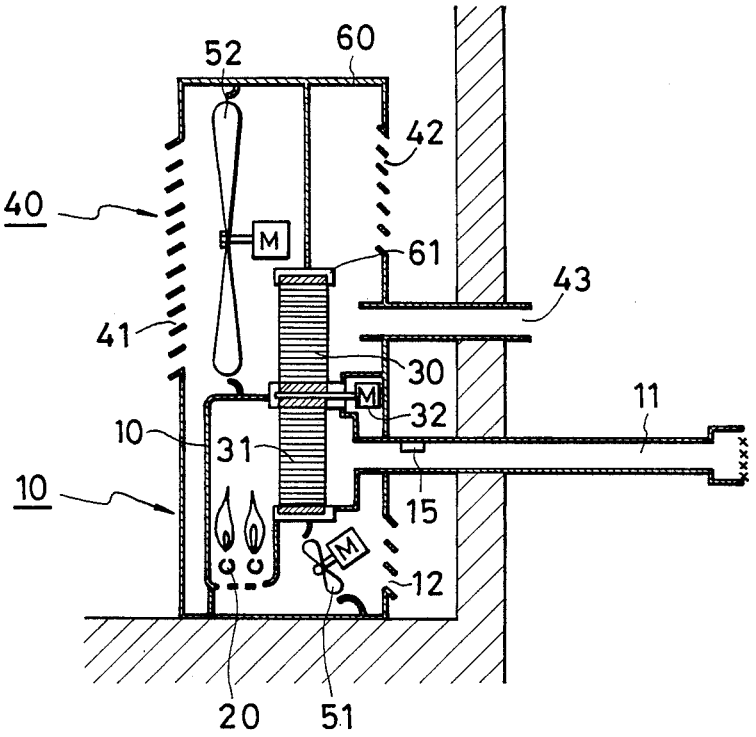

FIG. 3 illustrates another embodiment of the present invention which is distinguished from the previous embodiment in that an exterior air suction port 43 is provided in the ventilation section 40 for sucking fresh air from the exterior of the room, in addition to the suction port 42 for sucking air from the interior of the room.

By virtue of this structure, the air within the room can simultaneously be refreshed while the room is heated.

Although not shown in detail, the exterior air suction port 43 may be provided with an opening-closing device so that the air within the room can be cleaned if desired.

Further, as described before in the previous embodiment, if a moisture-absorbing material is applied to the flow passages 31 of the rotary body 30, this can prevent moisture condensation and, hence, corrosion of the heater, thereby increasing usable life of the heater.

Figure 4:
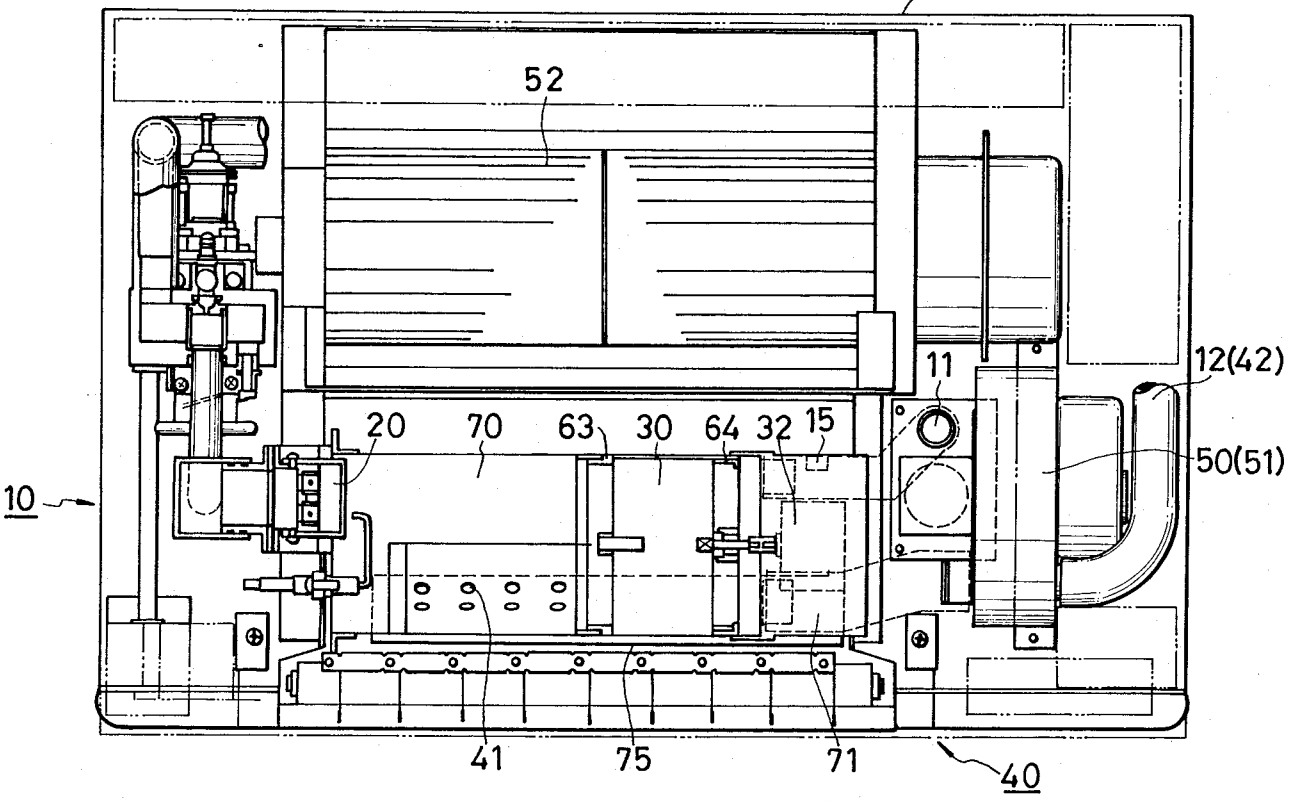
Figure 5:
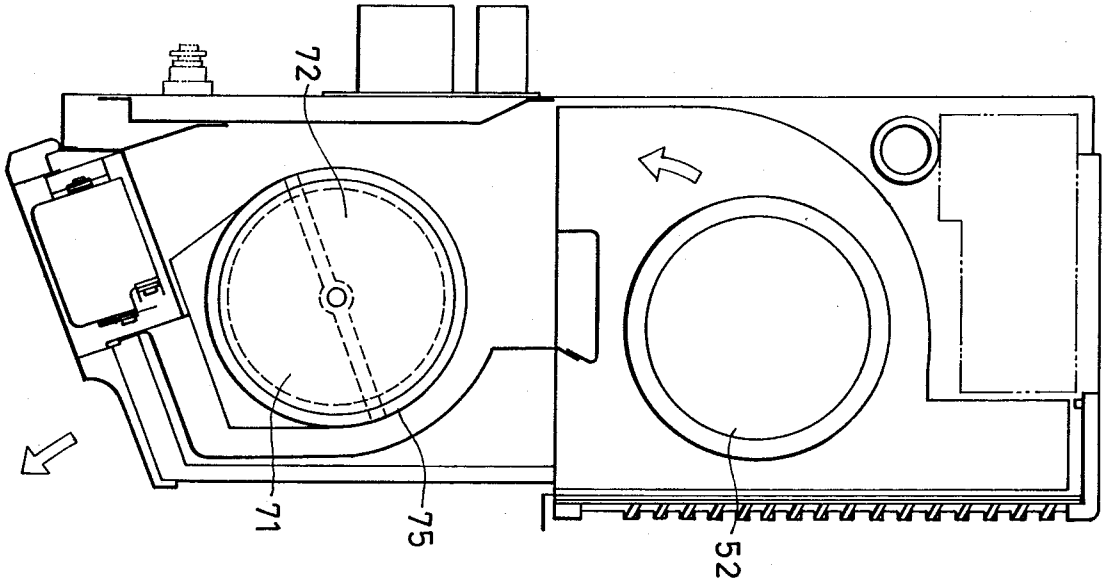

FIGS. 4 and 5 illustrate another embodiment of the present invention.

In contrast with the embodiment illustrated in FIG. 2 or 3 in which the ventilation fan 52 for ventilating the room is also used as a heat exchange fan so that air which has been subjected to heat exchange with the rotary body 30 is supplied directly into the room, a heater in accordance with this embodiment has a heat exchange fan 50 and a ventilation fan 52 which are separate from each other. This embodiment is also distinguished from the previous embodiments in that the heat exchange fan 50 also serves as a suction fan 51 for supplying air to a gas burner unit 20.

More specifically, the construction of a heater in accordance with this embodiment is such that air sucked from the interior of the room by the suction fan 51 is supplied both to the gas burner unit 20 through a burner passage 70 and to a heat exchange section formed by the rotary body 30 through a heat exchange passage 71.

With this arrangement, heat exchange is effected in the following manner. Air which has been heated to a high temperature by the gas burner unit 20 passes through the burner passage 70 in such a manner as to heat the rotary body 30 and thus to exchange heat therewith, until the air arrives at the discharge port 11. The thus heated rotary body 30 then exchanges heat with air supplied through the heat exchange passage 71 by the suction fan 51.

Air at a high temperature resulting from this heat exchange is discharged to the interior of the room while its temperature is being reduced by an air current caused by the ventilation fan 52, so as to heat the room.

The heater in accordance with this embodiment has the following detailed structures. A heat exchange cylinder 75 is formed, and the rotary body 30 is disposed at a central location of the cylinder 75. A portion of the heat exchange cylinder 75 which corresponds to the position of the rotary body 30 is divided into two parts by a plane containing the axial center of the cylinder 75.

The burner passage 70 is formed in one of the parts of the bisected heat exchange cylinder 75, in such a manner that the passage 70 communicates the burner unit 20, which is adapted to burn gas supplied thereto with air supplied from the suction fan 51, with the exhaust port 11, while the heat exchange passage 71 is formed in the other part of the heat exchange cylinder 75, in such a manner that the passage 71 communicates a supply port for supplying air sucked by the suction fan 51 from the interior of the room with a supply port for supplying air at high temperature.

The air at a high temperature supplied from the corresponding supply port is discharged to the interior of the room while its temperature is being reduced by the air current caused by the ventilation fan 52.

The heater in accordance with the present invention is also adapted to heat the room by causing the heat generated in the combustion section 10 to be exchanged with that of the ventilation section 40, by virtue of the rotation of the rotary body 30 which is positioned across these sections 10 and 40 so as to rotate at that position.

Figure 6:
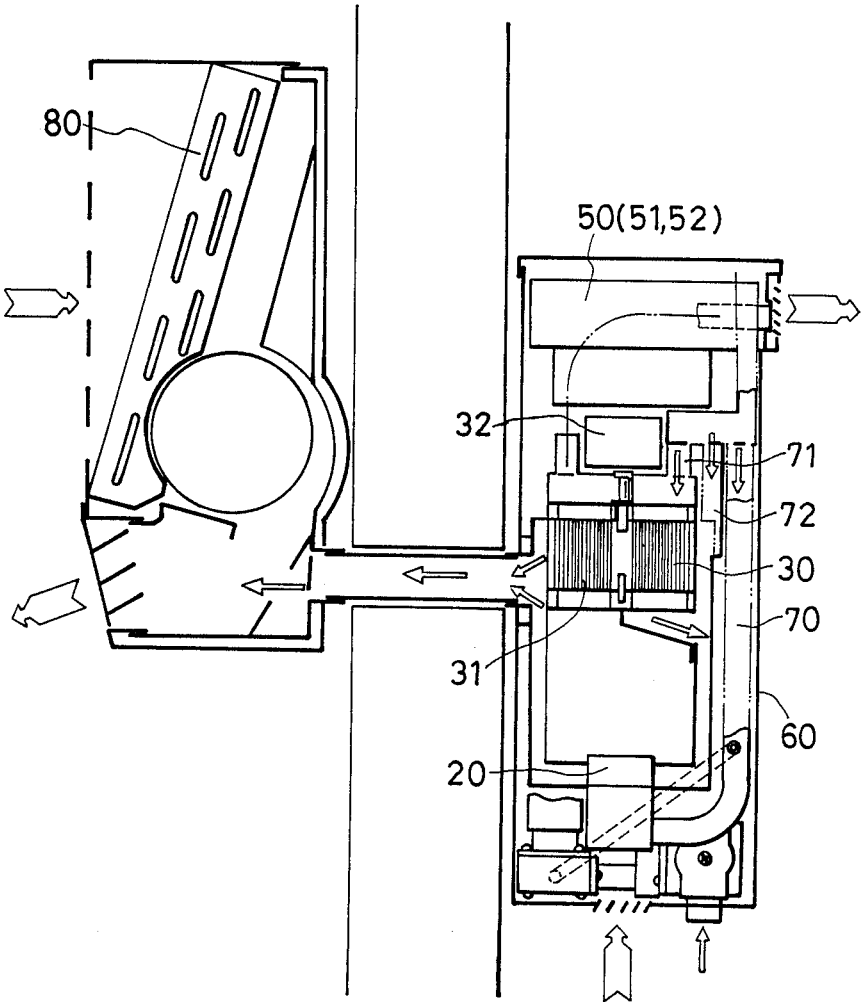

FIG. 6 illustrate a further embodiment in which a heater has a heater main body installed on the outside of the room and a cooler 80 disposed at a discharge port of the heater main body through which warm air is discharged into the interior of the room.

This embodiment is also distinguished from the foregoing embodiments in that a single fan serves as all the heat exchange fan 50, the ventilation fan 52, and the suction fan 51.

More specifically, air from the single fan 50 (51, 52) is allowed to flow in a branched manner through three passages, so as to effect heat exchange. The three passages are the burner passage 70 leading to the gas burner unit 20, the heat exchange passage 71 provided for the purpose of heat exchange, and a dilution passage 72 for enabling air at a high temperature which has been subjected to heat exchange to be diluted and supplied.

Although the dilution passage 72 may not necessarily be provided, it is provided in this embodiment for the following reason. Since the construction of the heater is such that the heater main body per se is disposed outside of the room, and warm air alone is discharged into the interior of the room, it is necessary to reduce the temperature of the air to be discharged to the interior of the room with a view to preventing the wall of the room from becoming overheated. The dilution passage 72 is, therefore, provided to reduce the temperature of the warm air.

With the heater in which the heater main body and the cooler 80 are combined in accordance with the this embodiment, the heater can be used as a heating means when the weather is cold while it can be used as a cooling means when the weather is hot by actuating the cooler 80.

The rotary body 30 used in each of the above-described embodiments will be described in detail with reference to the perspective views shown in FIGS. 7 and 8.

The rotary body 30 is formed into a generally cylindrical shape with a thin material, and is adapted to rotate at a low speed when it is driven by the rotary motor 32 as it is supported by the guide 61 provided in the frame body 60.

Figure 7:
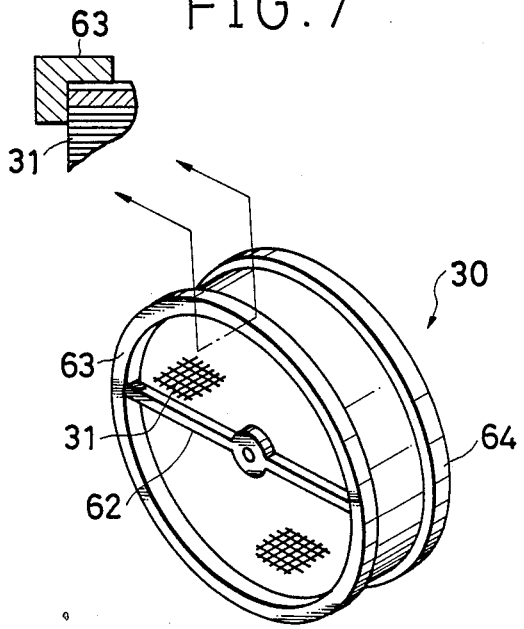
FIGS. 7 and 8 are perspective views showing rotary bodies.
Figure 8:
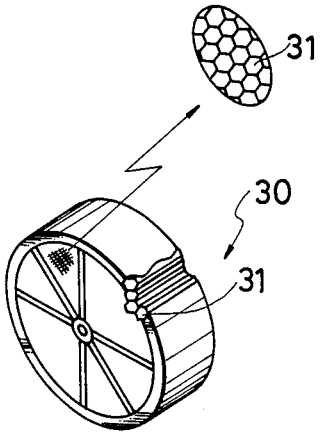

The rotary body 30 has the flow passage 31 which each have a suitable configuration such as a lattice-shaped configuration (FIG. 7) or a honeycomb configuration (FIG. 8). These flow passages 31 may be formed by, for instance, preparing an extruded material, such as a monolith-type support for a catalyst in an automobile, and forming the material into a cylindrical shape. Further, the surface of the flow passages 31 may be provided with an moisture-absorbing material by a suitable method such as coating or impregnating.

The rotary body 30 may alternatively be formed into another suitable structure using another suitable material. For instance, the body 30 may be formed of an extruded aluminum material, or a molded porous ceramic material. The body 30 may alternatively be formed by corrugating a material such as a sheet of asbestos paper or metal and forming a cylindrical body by helically winding the corrugated sheet.

With the rotary body 30 shown in FIG. 7, a partition plate 62 is provided in the frame body 60 between the combustion section 10 and the ventilation section 40, in order to prevent the air flow in the combustion section 10 and that in the ventilation section 40 from becoming mixed with each other. Further, suitable means, such as a labyrinth seal, is provided in the gap between the rotary body 30 and the guide 61, or between the rotary body 30 and the partition plate 62, so as to make the size of the gap small.

The arrangement of the guide 61 is such that a mechanical seal 63 and an elastic seal 64 are combined and are used on the different sides of the guide 61. That is, the mechanical 63 is formed of, for instance, a ceramic material and is used on the side of the guide 61 that is closer to the gas burner unit 20 and that is thus liable to be exposed to high temperatures, while the elastic seal 64, such as a Teflon labyrinth seal or a diaphragm seal, is used on the side of the guide 61 that is remote from the gas burner unit 20 and that is thus possibly exposed to low temperatures. Thus, it is made possible to enhance both the level of the sealing performance on the low-temperature side and the level of precision in dimensions of the members concerned on the high temperature side.

If both sides of the guide 61 are composed of mechanical seals 63, the sealing performance may be lowered. On the other hand, if both of these sides are composed of elastic seals 64, the high-temperature side of the guide 61 may be thermally affected and be deformed. Thus, both of these arrangements are not suitable for use. In contrast with this, the guide 61 of the present invention is provided with the combination described in the previous paragraph, thereby enabling to prevent any thermal deformation as well as to provide a level of performance sufficient for use.

With a heater having the construction as described above, there is a risk that a small part of the combustion air in the combustion section 10 may leak to the ventilation section 40, resulting in discharge of air used in the combustion, if no measures were taken against this risk. According to the present invention, therefore, the internal pressure of the ventilation section 40 is set at a value higher than that of the combustion section 10. With this arrangement, even though a part of the air sucked into the ventilation section 40 may flow into the combustion section 10, there is no risk that any part of the air in the combustion section 10 may flow into the ventilation section 40, thus preventing any of the air used in the combustion from being discharged into the interior of the room.

There is another risk that the rotary body 30 may not rotate due to certain factors. If this should take place, air at a high temperature would flow toward the exhaust port 11, causing the guide 61 and the entire heater to be heated. This may cause malfunction of the heater or even a fire.

According to the present invention, therefore, a temperature sensor 15 is provided in the vicinity of the exhaust port 11, so that a condition in which the rotary body 30 does not rotate, i.e., in which the temperature in the vicinity of the exhaust port 11 is abnormally high, can be detected by the temperature sensor 15. This detection is followed by an operation of stopping the supply of gas or outputting information on the abnormal condition.

Figure 10:
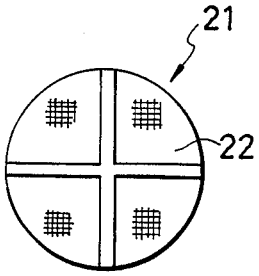
Figure 11:
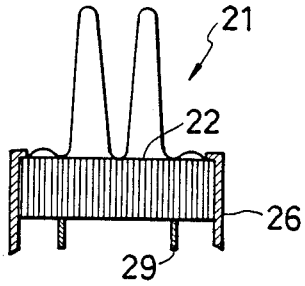

Certain examples of the gas burner unit 20 which may preferably be used in the heater of the present invention will now be described with reference to FIGS. 9, 10, and 11.

Figure 9:
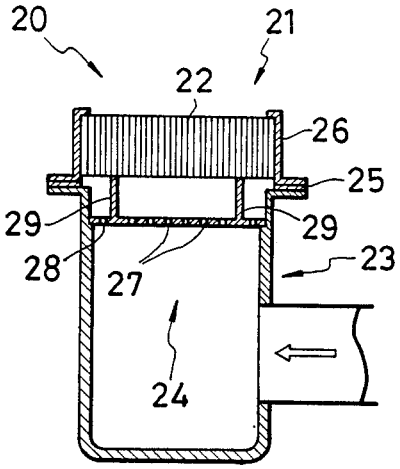
FIGS. 9 to 11 are views showing a gas burner unit.

FIG. 9 is a sectional view of the gas burner unit 20; FIG. 10 is a plan view of an example of a flame hole surface 22 of a honeycomb body 21 of the gas burner unit 20 for injecting a gas mixture; and FIG. 11 is a sectional view of the flame hole surface 22, which shows the combustion state.

The gas burner unit 20 mainly comprises a main body 23 to which a mixture of air and gas is supplied, a communication plate 24 fixed to the upper portion of the body 23, and the honeycomb body 21 fixed in place above the communication plate 24 by a fixing member 26 through a thermal-resistant packing 25.

The communication plate 24 is formed therethrough with a large number of main openings 27 for introducing a primary gas mixture and producing main flames, and with a small number of peripheral openings 28 for producing peripheral flames. Distribution cylinders 29 are provided on the upper surface of the communication plate 24 for defining spaces through which the primary gas mixture is supplied in such a manner as to be distributed for producing main flames and for producing peripheral flames.

The distribution cylinders 29 may be either integral with the communication plate 24 or separate therefrom. Further, the cylinders 29 may be fixed to the honeycomb body 21.

The honeycomb body 21 is formed of a ceramic material and has cells. If the cells are each rectangular-shaped, each cell should preferably have a side length of about 1 mm, a wall thickness of 0.15 to 0.3 mm, and an opening ratio of 60 to 80%. If each of the cells has a different configuration, the dimensions and the opening ratio of each cell may be different from those stated above. The flame hole surface 22 of the honeycomb body 21 is divided into four parts (see FIG. 10). Accordingly, the primary gas mixture is injected and burned as it is divided into four parts.

The reasons why the honeycomb body 21 is formed of a ceramic material are as follows:

(1) Since a ceramic material has a small thermal conductivity, the use of a ceramic material can prevent backfires;

(2) A ceramic material has thermal resistance;

(3) In general, backfires are prevented by reducing the diameter of a flame hole. However, if the diameters of flame holes are reduced, this may lead to an increased pressure loss. To compensate for this loss, it has conventionally been necessary to increase the internal pressure of the burner and to increase the area of the flame hole surface 22. In contrast with this, if a honeycomb body is formed of a ceramic material, the opening ratio remains substantially constant even if the diameter of each cell is reduced. This arrangement makes it possible to prevent backfires with only a very slight increase in the pressure loss at the flame hole portion of the burner; and (4) Since a ceramic honeycomb body is commercially available, the production cost can be cheap.

In the actual combustion operation of the burner unit 20 described above, as shown in FIG. 11, a gas mixture is supplied to the honeycomb body 21 through the distribution cylinders 29. The thus supplied gas mixture is injected and burned in such a manner that the mixture is separated into two parts, that is, a part which is at the peripheral portion of the flame hole surface 22 of the honeycomb body 21 and which is to be used in producing peripheral flames and a part which is at the central portion of the flame hole surface 22 and which is to be used in producing main flames.

Further, since the flame hole surface 22 of the honeycomb body 21 is divided into four parts, as described before, the gas mixture is injected and burned as it is divided into four parts. By virtue of this arrangement, the main flames are divided into groups and the thus divided groups of main flames behave in such a manner as to stabilize each other. This makes it possible for the combustion to be performed under an increased load. The number of parts into which the flame hole surface is divided is not be limited to four and may be another suitable number.

As described above, the heater in accordance with the present invention has a rotary body which is positioned across the combustion section and the ventilation section so as to rotate at that position, the rotary body having air flow passages for effecting heat exchange. Therefore, the heater is capable of providing a much increased heat exchange efficiency, and is also capable of supplying vapor generated during combustion to the interior of the room to thereby prevent the interior of the room from being abnormally dried.

We claim:

1. A heater adapted to provided heat for heating a room by effecting heat exchange in a heat exchange section which is between a combustion section and a ventilation section, said heat exchange section comprising a rotary body positioned across said combustion section and said ventilation sections as to rotate at that position, said rotary body having air flow passages extending in the same direction as the axis of rotation of said rotary body, said heat exchange section, said combustion section and said ventilation section being all contained in a heat exchange cylinder, and air at a high temperature resulting from the heat exchange in said heat exchange cylinder being discharged to the interior of the room while mixing with and having its temperature reduced by an air current blown against the heat exchange cylinder by a ventilation fan.

2. A heater according to claim 1, wherein said ventilation section has an internal pressure higher than that of said combustion section.

* * * * *